United States Patent [19]

Tsuda et al.

[11] Patent Number: 4,702,591

[45] Date of Patent: Oct. 27, 1987

[54] CLEANING DEVICE FOR AN IMAGE FORMING APPARATUS

[75] Inventors: Tadayuki Tsuda; Katsumi Kurematsu, both of Kawasaki, Japan

[73] Assignee: Canon Kabushiki Kaisha, Tokyo, Japan

[21] Appl. No.: 795,177

[22] Filed: Nov. 5, 1985

[30] Foreign Application Priority Data

Nov. 9, 1984 [JP] Japan ..... 59-235035
Nov. 9, 1984 [JP] Japan ..... 59-235039

[51] Int. Cl.[4] ..... G03G 15/08

[52] U.S. Cl. ..... 355/15; 355/3 DD; 355/14 D; 118/652

[58] Field of Search ..... 355/15, 3 DD, 14 D; 15/1.5 R, 256.5; 118/652

[56] References Cited

U.S. PATENT DOCUMENTS 3,526,457 9/1970 Dimond et al. ..... 355/15
3,792,925 2/1974 Milligan et al. ..... 355/15
4,364,660 12/1982 Oda ..... 355/15
4,396,276 8/1983 Murasaki ..... 355/15
4,465,363 8/1984 Schmitt et al. ..... 355/15
4,502,779 3/1985 Kajita et al. ..... 355/15
4,519,699 5/1985 Mayer et al. ..... 355/15

FOREIGN PATENT DOCUMENTS 53-22435 11/1978 Japan ..... 355/15

*Primary Examiner*—A. C. Prescott
*Assistant Examiner*—C. Romano
*Attorney, Agent, or Firm*—Fitzpatrick, Cella, Harper & Scinto

[57] ABSTRACT

A cleaning device for an image forming apparatus such as an electrophotographic copying machine wherein the cleaning device is usable for removing toner from a photosensitive member. The cleaning device is effective to provide a solution to the problem caused by the toner particles and other foreign matter gripped between the cleaning member and the photosensitive member. According to this invention, the problems are solved by controlling the manner of bringing the cleaning member into contact with the photosensitive member and/or the manner of bringing the same out of contact.

4 Claims, 8 Drawing Figures

CLEANING DEVICE FOR AN IMAGE FORMING APPARATUS

FIELD OF THE INVENTION AND RELATED ART

The present invention relates to an image forming apparatus such as an electrophotographic copying apparatus, printer and electrostatic transfer process wherein an image is developed with toner, more particularly, it relates to a cleaning device usable therewith.

As for a cleaning device usable with such an image forming apparatus, a cleaning blade of an elastic material such as rubber is known in order to remove the remaining toner from a surface of an image bearing member of the apparatus. The cleaning blade is widely used because of its excellent toner removing effects and its simple and compact structure.

The cleaning blade has an edge press-contacted to the surface of the image bearing member, and the surface is moved relative to the edge, so that the toner is scraped off. If, however, it is always press-contacted thereto, a problem arises in which a small amount of toner remaining in the vicinity of the press-contacted edge is caked during non-use of the apparatus, resulting in a poor quality of the image formed by the image forming apparatus. In order to avoid this problem, a measure is recently taken by which the blade is press-contacted to the surface of the an image bearing member only during image forming operation, and it is retracted out of the press-contact position when the apparatus is not in operation.

In this type of the cleaning device, adjacent the edge of the cleaning blade, there may be toner particles, fine paper dust produced from an image transfer material such as a paper, deposit of rosin and talc, corona products produced within the image forming apparatus and various other foreign matter which have been deposited on the cleaning blade adjacent the edge during the previous image forming operations. When the cleaning blade is brought into contact with the surface of the image bearing member, the foreign matter is disposed between the cleaning blade edge and the image bearing member, and therefore, the blade edge does not uniformly contact the image bearing surface over the entire length thereof resulting in insufficient cleaning, during the initial stage of the started or resumed image forming operation.

The foreign matter is removed with continuation of the cleaning operation, so that the cleaning operation is gradually stabilized. However, the above-described drawbacks require additional and wasteful operation.

From another aspect, a spring or weight is used as the structure for engaging or press-contacting the blade to and disengaging it from the image bearing surface. Therefore, the cleaning blade may impact or suddenly press-contact the image bearing surface. If the instantaneous pressure therebetween is excessively high, the cleaning blade can be bent to such an extent that surface contact, not line contact, can occur therebetween. If this occurs, the foregin matter adjacent the image bearing surface such as the toner is strongly pressed to the image bearing surface, and therefore, the surface of the image bearing member may be damaged.

From antoher aspect, the cleaning blade is disengaged from the image bearing surface after the image bearing member stops. During rotation of the image bearing member, the cleaning blade deforms by the force provided by the image bearing member through the contact therebetween, that is, the blade is compressed. At the instance when the image bearing member stops, the deformation suddenly disappears by the expansion of the compressed blade. This reaction of the blade rubs the image bearing member surface with the result of fusing the toner and damaging the image bearing surface through the foreign matter.

SUMMARY OF THE INVENTION

Accordingly, it is a principal object of the present invention to provide a cleaning device for an image forming apparatus, of the type in which a cleaning member is contacted to an image bearing member, and it scrapes off the remaining toner, wherein a measure is taken by which it is avoided that the toner is nipped between the cleaning member and the image bearing member.

It is another object of the present invention to provide a cleaning device for an image forming apparatus wherein the the toner is prevented from being nipped by controlling the engaging and disengaging action of the cleaning member.

It is a further object of the present invention to provide a cleaning device for an image forming apparatus wherein a simple means is provided in association with the engaging and disengaging mechanism, which is effective to prevent the toner from being nipped.

According to an embodiment of the present invention, the cleaning member is press-contacted to the image bearing member surface under a higher pressure at an initial stage than the normal pressure, whereby the toner or other foreign matter deposited to the cleaning member is forcefully removed so that a good quality of image is provided from the initiation or resumption of the image forming operation.

According to another embodiment of the present invention, the cleaning member is disengaged or separated from the image bearing surfce prior to the stop of the rotation of the image bearing member. By doing so, the possible adverse influence to the image bearing surface which may otherwise be caused by the cleaning member at the start and stop of the rotation, can be avoided.

These and other objects, features and advantages of the present invention will become more apparent upon a consideration of the following description of the preferred embodiments of the present invention taken in conjunction with the accompanying drawings.

BREIF DESCRIPTION OF THE DRAWINGS

DETAILED DESCRIPTION OF THE PREFERRED EMBODIMENTS

First, the description will be made with respect to an embodiment in which the problems arising when the cleaning member is brought into contact to the image bearing member are solved.

Figure 1:
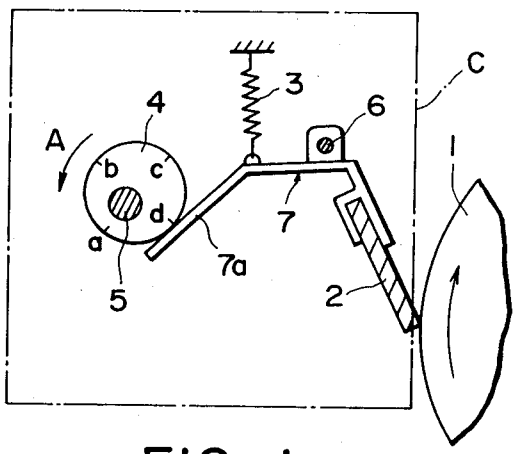
FIG. 1 is a side view of a cleaning device according to an embodiment of the present invention.

FIG. 1 is a side view of a part of an exemplary electrophotographic copying apparatus having a photosensitive member 1 in the form of a cylinder, which is to be cleaned by the cleaning device according to this embodiment. In contact with the photosensitive member 1, there is a cleaning device C, which comprises a cleaning blade 2 which is disengageably press-contacted to the photosensitive member 1.

As is well known, there is a charger, a latent image forming station, a developing apparatus and an image transfer station around the photosensitive member 1 to form an image. The cleaning device C is provided with means for correcting and discharging the removed toner, but those means are not essentially concerned with the present invention, and therefore, the description is omitted.

The cleaning blade 2 of the cleaning device C extends in the direction of the rotational axis of the photosensitive member 1, that is, perpendicularly to the surface of the drawing. The cleaning blade 2 is supported by a supporting member 7, which is pivotably supported on a shaft 6 and is normally urged in the clockwise direction in FIG. 1 by a spring 3 so that the cleaning blade 2 is normally urged in the direction away from the surface of the photosensitive member 1.

The supporting member 7 has an end portion which is formed into a cam follower lever 7*a*, to which a cam 4 is rotatably mounted on a shaft 5. Since the supporting member 7 is urged by the spring 3 in the direction described above, the lever 7*a* is normally press-contacted to the cam surface of the cam 4.

In this embodiment, the cam 4 has an eccentric circular cam surface. The minimum radius point is indicated by a reference "a", and the maximum radius by "c". Points b and d are inbetween. The cam 4 is controlled by an unshown control means so as to stop at a position where the point a and the lever 7*a* are contacted and at a position wherein the point d is contacted to the lever 7*a*. The radius of the cam surface is predetermined such that the blade 2 is disengaged from the surface of the photosensitive member 1 when the former position is taken, while it is press-contacted thereto when the latter position is taken.

Figure 2:
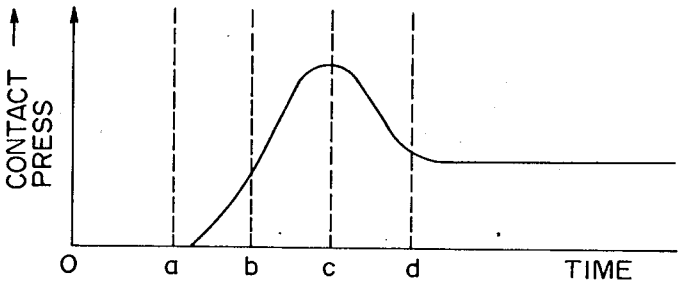
FIG. 2 is a graph showing change of pressure between the cleaning member and the image bearing member surface.

Therefore, when the lever 7*a* rotates in the direction of an arrow A from a position where the lever 7*a* is contacted to the cam surface at the point a wherein the cleaning blade 2 is disengaged from the photosensitive member 1, the lever 7*a* rotates in the counterclockwise direction while contacting the cam surface at the points b and c, so that the blade 2 is press-contacted to the surface of the photosensitive member 1. The cam 4 stops at a position where the lever 7*a* contacts the point d of the cam surface. Since the radius of the cam surface of each of the points a, b, c and d is as described above, the force of the press-contact between the blade 2 and the photosensitive member 1 changes as shown in FIG. 2. The change in the pressure stops adjacent the point d, and thereafter, the pressure is constant.

Because of this structure, the cleaning blade 2 is contacted to the photosensitive member surface under a higher pressure, and it produces a larger deformation at the initial stage than in the usual state of operation. Because of this tentative high pressure, the foreign matter such as the toner deposited on the edge of the cleaning blade 2 is removed therefrom and falls, or it is brought away by the rotating photosensitive member 1, thus cleaning the edge. When the pressure is lowered to the normal level, the cleaning member is able to instantaneously perform its normal cleaning function.

In the foregoing embodiment, the pressure is increased immediately in response to the start of the cleaning operation, but the similar effects can be obtained by changing the contour of the cam surface so that the pressure is increased at a proper point between the start of the blade operation and the first image forming operation. Also, the number of pressure increases is not limited to one but may be plural.

Figure 3:
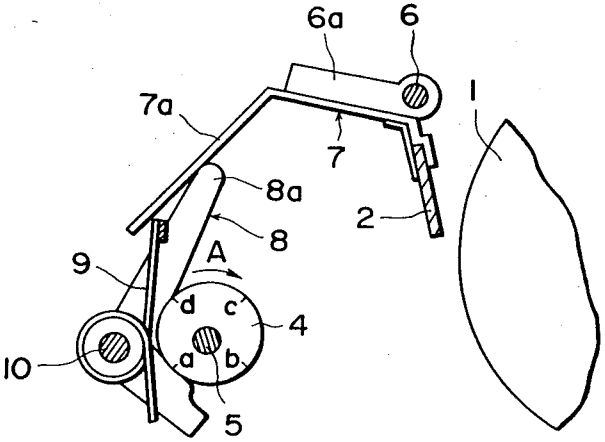
FIG. 3 is a side view of a cleaning device according to another embodiment of the present invention.

FIG. 3 illustrates a cleaning device according to another embodiment of the present invention. Similarly to FIG. 1 embodiment, the cleaning device is used with a copying machine. The corresponding elements are assigned the same reference numerals, and therefore, the detailed description thereof will be omitted for the sake of simplicity. In this embodiment, the supporting member 7 is pivotably supported on a shaft 6 and is urged in the counterclockwise direction by a weight 6*a*, that is, the direction for press-contacting the blade 2 to the photosensitive member 1.

An end portion of the supporting member 7 is formed into a lever 7*a*, which is contacted to a cam follower 8 in the form of a bell crank pivotably supported on a shaft 10. The cam follower 8 has an end 8*a* disposed in the movable range of the lever 7*a*. The cam follower 8 is normally urged by a spring 9 in the counterclockwise direction. The cam follower 8 has an arm which is contacted to a cam 4 fixedly mounted on a shaft 5.

When the shaft 5 is rotated by an unshown driving device so as to rotate the cam 4, the cam follower 8 takes the most counterclockwisely rotated position at the minimum radius point a of the cam surface, whereby the end 8*a* contacted to the lever 7*a* disengages the blade 2 from the photosensitive member 1 surface.

With the continued rotation of the cam 4 in the direction of an arrow A, the cam follower 8 rotates in the clockwise direction away from the lever 7*a*, whereby the blade 2 is brought into contact with the photosensitive member 1. When the cam 4 rotates to such an extent that the end 8*a* is disengaged from the lever 7*a* (the neighborhood of the point b is contacted to the cam follower 8), the cleaning blade is press-contacted under a constant maximum pressure determined by the weight 6*a*. The cam 4 is further rotated so that the cam radius becomes a predetermined, the cam follower 8 rotates in the counterclockwise direction so as to rotate the lever 7*a* through the end portion 8*a*, thus moving the cleaning blade 2 in the direction away from the photosensitive member 1. And, the cam 4 is stopped at such a position that the cleaning blade 2 is press-contacted to the photosensitive member 1 under a predetermined pressure, and the cleaning member 2 performs a usual cleaning operation.

Figure 4:
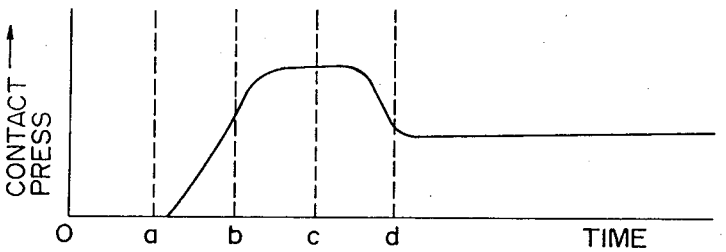
FIG. 4 is a graph showing the change of pressure between the cleaning member and the image bearing surface.

In this embodiment, as shown in FIG. 4, the time period during which the pressure is high can be prolonged within the time period from the cleaning blade 1 contacting to the photosensitive member to the pressure becoming the predetermined level. Because of this, the cleaning of the blade edge is further improved.

Figure 5:
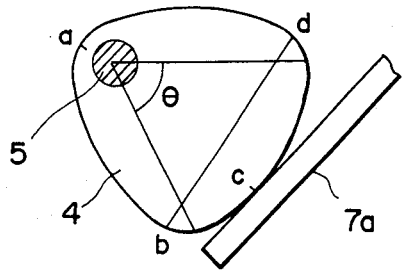
FIG. 5 is an enlarged side view of a cleaning device according to another embodiment of the present invention.

FIG. 5 shows another example of a cam 4 usable with the device of FIG. 1. The cam supported on the shaft 5 has such a contour that the cam surface between the point b and d through c has the same radius over the range of the angle $\theta$ as seen from the center of the shaft 5. Using such a cam 4, the nature of the pressure change as shown in FIG. 4 can be provided without using the intermediate member such as the cam follower 8 as in FIG. 3.

In the foregoing embodiments, the description has been made with respect to the cleaning device used with a copying machine, but the cleaning device of these embodiment can be used with other image forming apparatuses.

It has been confirmed that when the cleaning devices of these embodiments replace the conventional cleaning device which actually causes a problem immediately after the cleaning blade is operated in a copying apparatus, no trouble occurs.

Now, the description will be made with respect to embodiments wherein the problems caused when a cleaning member is disengaged from the image bearing member.

Figure 6:
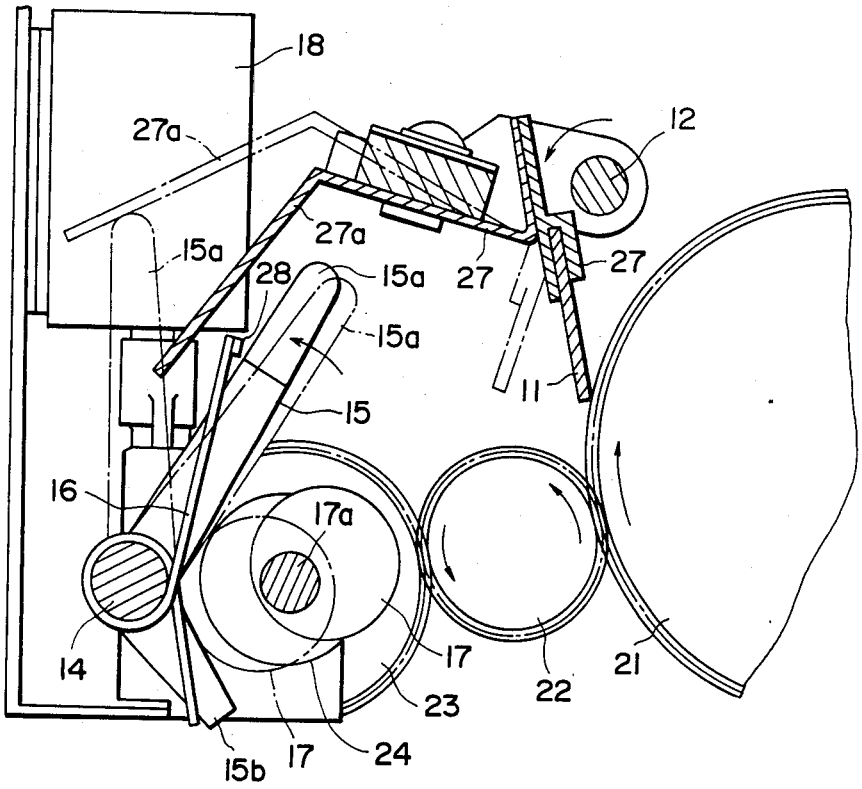
FIG. 6 is a side view of a major part of a copying apparatus to which the present invention is applied.

FIG. 6 is a side view of a cleaning device according to an embodiment of the present invention used with an electrophotographic copying machine. A cleaning blade 11 is provided in an unshown casing of the cleaning device so as to be contactable to an unshown photosensitive member in the form of a cylinder. The cleaning blade 11 is mounted to a supporting member 27 which is pivotably supported on a shaft 12. The cleaning blade is normally urged to the photosensitive member by its own weight and that of the supporting member 27.

The supporting member 27 is formed into a lever 27*a* at an end portion remote from the cleaning blade 11. The cleaning device further includes a shaft 14 to which a cam follower 15 in the form of a bell crank is rotatably supported. The cam follower 15 is normally urged in the counterclockwise direction as seen in this Figure by a spring 16 having an end engaged to proper fixed portions (28) of the casing.

An eccentric cam 17 is fixedly mounted to a shaft 17*a* disposed in the casing and is rotated by way of a clutch 24 and a gear 21, an intermediate gear 22 and gear 23 rotatable with the photosensitive member. One engaging operation of the clutch 24 rotates the cam 17 through one full turn from the position shown by solid lines in FIG. 6. When the cam 17 rotates through one full turn, it pushes an end 15*b* of the cam follower 15 so as to swing the cam follower 15 between a position indicated by chain lines and a position shown by solid lines. With this movement of the cam follower 15, the lever 27*a* is rotated in the counterclockwise direction against the force of the spring 16. This moves the cleaning blade 11 from a retracted position to the contacted position.

Figure 7:
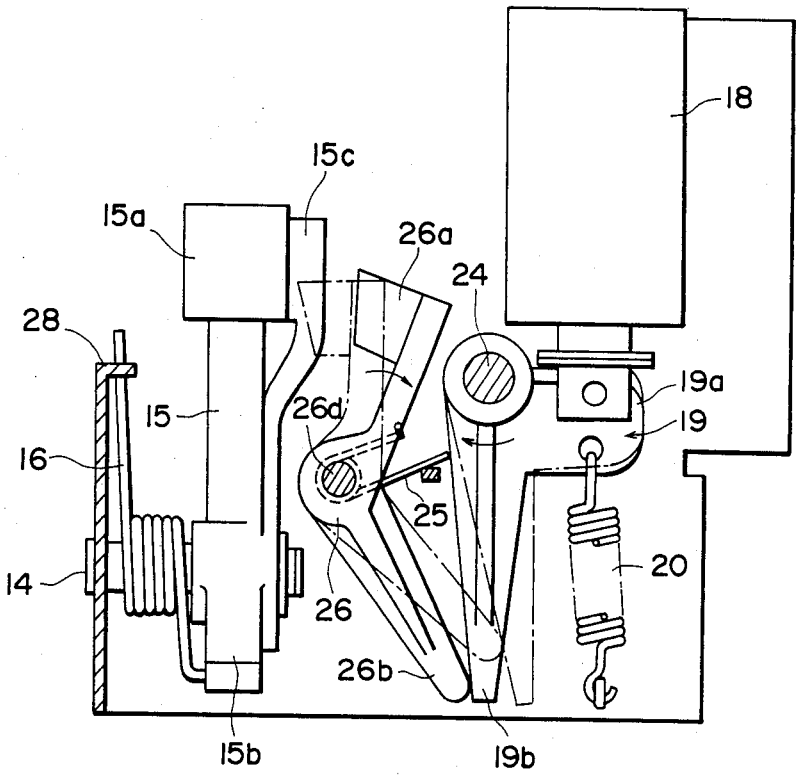
FIG. 7 is a top plan view of the apparatus of FIG. 6.

FIG. 7 illustrates a mechanism for preventing the cam follower 15 from being urged in the counterclockwise direction by the spring 16, thus maintaining the cleaning blade 11 at a position of press-contacting to the photosensitive member.

This mechanism includes a solenoid 18 having a core mounted to one of the arms 19*a* of the bell crank 19 rotatably mounted on the shaft 24. The arm 19*a* is connected to a spring 20 so as to normally urge the bell crank 19 in the clockwise direction.

The other arm 19*b* of the bell crank 19 is rotatably mounted on a shaft 26 and is resiliently contacted to one of the ends 26*b* of the lever 26 which is normally urged in the counterclockwise direction by a spring 35. In FIG. 7, the solid lines indicate the positions of elements taken when the solenoid 18 is deenergized. When the solenoid is energized, the bell crank 19 rotates to the position shown by the chain lines, and therefore, the end 26*b* of the lever 26 rotates to the position indicated by the chain lines while contacting to the bell crank 19. At this time, the end 26*a* of the other arm of the lever 26 shifts to the chain line position and engages the cam follower 15, so as to take a position wherein the rotation of the cam follower 15 by the spring 16 is retarded.

In this embodiment, the solenoid 18 and a driving motor for the photosensitive member are actuated or deactivated electrically simultaneously, so that the bell crank 19 and the clutch 24 are operated mechanically simultaneously.

The operation of this embodiment will be described. The cam follower 15 is urged by the spring 16 and pivots the suppporting member 27 so as to disengage the cleaning blade 11 from the photosensitive member. When the driving motor for the photosensitive member starts from this state, the cam 17 starts rotating through the gears 21, 22 and 23. Simultaneously, the clutch 20 operates, and the solenoid 18 is energized. With the rotation of the cam 17, it contacts the end 15*b* to rotate the cam follower 15 in the clockwise direction against the spring force of the spring 16. Sooner or later, the cam follower 15 is disengaged from the lever 27*a* with the result that the cleaning blade 11 is contacted to the surface of the photosensitive member.

Figure 8:
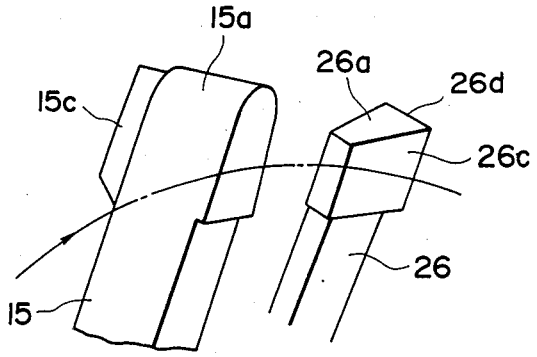
FIG. 8 is a perspective view of a cam follower and a lever, illustrating the relation therebetween.

On the other hand, the energization of the solenoid 18 rotates the bell crank 19 in the counterclockwise direction against the force of the spring 20. By this, the lever 26 takes the position shown by the chain lines in FIG. 7. At this time, the end 26*b* of the lever is contacted to an end of the bell crank by the spring 25, and the other end 26*a* of the lever 26 takes the position indicated by the chain lines, that is, it is moved to a position wherein it interferes with the cam follower 15. During this, the cam follower 15 is rotated by the cam 17 so that it contacts in its moving path to the end 26*a* of the lever 26. As shown in FIG. 8, that surface of the end 26*a* of the lever 26 which is contactable to the cam follower 15 is tapered (26*c*), so that with the rotation of the cam follower 15, the side 15*c* of the cam follower 15 pushes the tapered surface 26*c*. Therefore, the lever 26 is slightly rotated in the clockwise direction in FIG. 7, that is, away from the photosensitive drum against the force of the spring 25.

The cam follower 15 moves further beyond the position of the lever 26 by the rotation of the cam 17. The cam 17 stops due to the function of the clutch when the cam 17 rotates through one turn. At this time, it reaches an extreme position 15*a* indicated by chain lines. At this time, the cam follower 15 has now not been acted by the cam 17, the cam follower 15 moves back in the counterclockwise direction (FIG. 6) by the force of the spring 16 and stops contacting surface 26*d* of the end 26*a* of the lever 26, whereby the cleaning blade is maintained at the operating position.

Upon the driving motor deactivated because of termination of the copying operation or upon a trouble in the power source or occurrence of paper jam or the like, the solenoid 18 is deenergized, by which the bell crank 19 immediately restores to the position indicated by the solid lines in FIG. 7, and the lever 26 is restored to its solid line position. Therefore, the end 26*a* of the lever 26 is retracted out of the path of the cam follower 15 movement. Then, by the force of the spring 16, the cam follower 15 quickly moves to the position indicated by chain lines in FIG. 6. This allows the cam follower 15 to rotate the supporting member 27 in the clockwise direction (FIG. 6) so as to retract the cleaning blade 11 to the position indicated by chain lines.

In this embodiment, when the cleaning blade 11 is brought into contact with the surface of the photosensitive member, it is contacted gradually by the function of the cam 17, while on the other hand, upon stoppage of the motor for driving the photosensitive member, the cleaning blade 11 is immediately and quickly disengaged from the photosensitive member surface. Therefore, when the driving motor is deactivated, the photosensitive member having a relatively large inertia continues rotating for a certain period of time. Therefore, the cleaning blade 11 is disengaged from the photosensitive member surfce prior to the complete stoppage of the photosensitive member.

Thus, the cleaning blade does not contact the photosensitive member under such a high pressure that the surface of the photosensitive member or the image bearing member is damaged; when the rotation of the image bearing member stops, the braking action of the elastic cleaning blade causing fusing of the toner can be avoided. Therefore, the cleaning function and effect are maintained stable over a long period of time.

In the foregoing embodiments, the image bearing member or the photosensitive member has been described as being a cylindrical or drum photosensitive member. However, the present invention is applicable to such a member in the form of a belt. As for the image bearing member other than the photosensitive member described in the foregoing, there is an insulating drum or belt for bearing a latent image formed by ions imagewisely modulated or by multistylus electrodes. In addition to the cleaning blade described in the foregoing, an elastic roller as disclosed in U.S. Pat. No. 3,838,472 is usable with the present invention, which roller is particularly advantageous when the relative speed between the image bearing member and the cleaning member is too large. Further, the cleaning blade has been described as being counter-directional with respect to movement of the surface of the image bearing member. However, the present invention is usable with a codirectional blade. Additionally, the present invention is applicable to a cleaning device of a so-called tip-blade type wherein a small elastic blade is fixed to an end of an elastic plate as shown in U.S. Pat. No. 4,026,648.

While the invention has been described with reference to the structure disclosed herein, it is not confined to the details set forth and this application is intended to cover such modifications or changes as many come within the purposes of the improvements or the scope of the following claims.

What is claimed is:

1. A cleaning device usable with an image forming apparatus for removing remaining toner particles from an image bearing member which is movable along an endless path, comprising;

a cleaning member contactable with a surface of the image bearing member at a position downstream with respect to the movement direction of the image bearing member, of a transfer station of the image forming apparatus where an image is transferred from the image bearing member; and control means for contacting said cleaning member with the image bearing member to clean the image bearing member and for disengaging said cleaning member from the image bearing member when no cleaning operation is to be performed, said control means including a cam and a cam follower engageable with the cam and mechanically interrelated with said cleaning member to move said cleaning member;

wherein upon the start of a cleaning operation, said cam follower relatively moves from a first position of said cam by way of a second position of said cam to a third position thereof, and wherein when said cam follower is in contact with the first position of said cam, said cleaning member is away from the image bearing member, when said cam follower is in contact with the third position of said cam, said cleaning member is in contact with the image bearing member, and when said cam follower is in contact with the second position of said cam, said cam cleaning member contacts the image bearing member with a greater force than when said cam follower is in contact with the third position of said cam.

2. A device according to claim 1, wherein said cleaning member is in a form of a blade.

3. A cleaning device usable with an image forming apparatus for removing remaining toner particles from an image bearing member which is movable along an endless path, comprising:

a cleaning member contactable with a surface of the image bearing member at a position downstream, with respect to the movement direction of the image bearing member of a transfer station of the image forming apparatus where an image is transferred from the image bearing member; and control means for contacting said cleaning member with the image bearing member to clean the image bearing member and for disengaging said cleaning member from the image bearing member when no cleaning operation is to be performed, said control means including a movable member mechanically interrelated to said cleaning member to move said cleaning member, a spring for resiliently urging said movable member in a predetermined direction, a cam member for moving said movable member against said spring to bring said cleaning member into contact with the image bearing member, said cam member disengaging from said movable member after said cleaning member contacts the image bearing member, and stopper means for retaining said movable member at a predetermined position from which said cam member is disengaged, wherein said stopper means is retracted before the image bearing member stops so that said cleaning menber is moved away from the image bearing member by said spring before the image bearing member is stopped.

4. A device according to claim 3, wherein said cleaning member is in a form of a blade.

* * * * *

UNITED STATES PATENT AND TRADEMARK OFFICE

CERTIFICATE OF CORRECTION

PATENT NO. : 4,702,591

DATED : October 27, 1987

INVENTOR(S) : TADAYUKI TSUDA, ET AL.

It is certified that error appears in the above-identified patent and that said Letters Patent is hereby corrected as shown below:

COLUMN 1

Line 29, "an" should be deleted.
Line 29, "during" should read --during an--.
Line 36, "a paper, deposit" should read --paper, a deposit--.
Line 61, "foregin" should read --foreign--.
Line 65, "antoher" should read --another--.

COLUMN 2

Line 3, "instance" should read --instant--.
Line 4, "suddently" should read --suddenly--.
Line 33, "to" should read --on--.
Line 39, "surfce" should read --surface--.

COLUMN 3

Line 8, "to" should read --with--.

COLUMN 4

Line 55, "a" should be deleted.

COLUMN 5

Line 15, "embodiment" should read --embodiments--.

COLUMN 6

Line 28, "clutch 20" should read --clutch 24--.

UNITED STATES PATENT AND TRADEMARK OFFICE

CERTIFICATE OF CORRECTION

PATENT NO. : 4,702,591

DATED : October 27, 1987

INVENTOR(S) : TADAYUKI TSUDA, ET AL.

It is certified that error appears in the above-identified patent and that said Letters Patent is hereby corrected as shown below:

COLUMN 7

Line 23, "surfce" should read --surface--.
Line 42, "wisely" should read --wise--.
Line 60, "many" should read --may--.

COLUMN 8

Line 2, "downstream" should read --downstream,--.
Line 27, "cam" should be deleted.
Line 40, "member of" should read --member, of--.
Line 62, "menber" should read --member--.

Signed and Sealed this

Ninth Day of August, 1988

*Attest:*

*Attesting Officer*

DONALD J. QUIGG

*Commissioner of Patents and Trademarks*